United States Patent [19]

Matsushita

[11] Patent Number: 4,559,766

[45] Date of Patent: Dec. 24, 1985

[54] DEVICE FOR AUTOMATIC TYING OF PACKAGES

[75] Inventor: Hidekatsu Matsushita, Kyoto, Japan

[73] Assignees: Matsushita Seiki Kabushiki Kaisha, Kyoto, Japan; Clements Industries, Inc., Hackensack, N.J.

[21] Appl. No.: 343,086

[22] Filed: Jan. 27, 1982

[30] Foreign Application Priority Data

Jan. 29, 1981 [JP] Japan ..... 56-12070

[51] Int. Cl.[4] ..... B65B 13/00

[52] U.S. Cl. ..... 53/586; 53/583; 53/370

[58] Field of Search ..... 53/227, 370, 583, 586; 74/529; 83/600, 601, 602, 609, 607, 649; 100/16, 17, 31; 140/93 A, 93.6

[56] References Cited

U.S. PATENT DOCUMENTS

| | | | |
|---|---|---|---|
| 1,013,201 | 1/1912 | Michel | 83/600 X |
| 1,927,708 | 9/1933 | Pieczentkowski | 53/586 X |
| 2,746,543 | 5/1956 | Gezich | 83/600 X |
| 3,898,924 | 8/1975 | Mead et al. | 100/31 X |
| 4,043,363 | 8/1977 | Tange | 53/583 X |
| 4,146,161 | 3/1979 | Lewis | 83/609 X |
| 4,169,346 | 10/1979 | Tange | 53/583 |
| 4,232,498 | 11/1980 | Uchida | 53/586 X |
| 4,316,760 | 2/1982 | Satomi | 100/17 X |

FOREIGN PATENT DOCUMENTS

| | | | |
|---|---|---|---|
| 126425 | 11/1947 | Australia | 140/93 A |
| 576125 | 5/1959 | Canada | 140/93.6 |
| 2165664 | 7/1972 | Fed. Rep. of Germany | 53/586 |
| 1127579 | 12/1956 | France | 53/586 |
| 2430889 | 8/1980 | France . | |
| 2001292 | 3/1978 | United Kingdom . | |

*Primary Examiner*—John Sipos
*Assistant Examiner*—Steven P. Weihrouch
*Attorney, Agent, or Firm*—Blum Kaplan Friedman Silberman & Beran

[57] ABSTRACT

In a device for automatic tying of packages, the raising of an arm and insertion of a package to be tied, followed by lowering of the arm, automatically draws from a reel the requisite quantity of twist-tape, cuts the tape away from the reel and ties the twist-tape into a knot. The twist-tape is the paper or vinyl tie having a soft wire sandwiched between two layers of the paper or vinyl material.

15 Claims, 13 Drawing Figures

DEVICE FOR AUTOMATIC TYING OF PACKAGES

BACKGROUND OF THE INVENTION

In general, binding devices which form a knot and bind an object by twisting, to close the opening of an open bag have been known in the art. However, with such devices, because of their mechanism, there is a rather strict limit on the size of an object to be bound; it is practically impossible to bind an object or package or material having some thickness, such as a vegetable, flower or fruit bundle, other than bagged things. In addition, the cost of such devices has been high because of the necessity for providing a twisting step.

Also, there is a binding device which uses an adhesive tape as a binding material. However, with such a tape, the adhesion surface will be directly in contact with the surface of the substance to be bound. This may cause a hygiene problem, or if the place of work is outdoors, dust, water, etc., may adhere to the adhering surface, thereby degrading the adhesion and making it impossible to achieve the required adhesion strength. In addition, where a binding is based on adhesion, it is not easy to untie the binding. In contrast, if the binding is performed by forming a knot through twisting, the strength of the knot will not be affected by dust or water, and it is easy to untie it. Furthermore, it is possible to re-bind it by re-twisting it. For these reasons, there has been a strong demand for a device which forms a knot and performs the binding operation of relatively large and thick objects and materials by twisting. However, in the design of a device to complete a binding operation by twisting a tape, it is necessary to provide a mechanism for carrying out the twisting step, as aforenoted, thereby increasing the complexity to some extent and increasing the cost relative to a device using an adhesion tape.

In general, for binding vegetables manually, binding by twisting a tape has been used, but in such a case, the tape has been cut to a standard or fixed length in advance which is not economical. Eventually, the hands become tired thereby setting a limit on the number of objects which an operator can bind.

The present invention solves this problem by providing a small and simple binding device which winds a binding material, hereinafter termed a twist-tape or simply a tape, around a thick material or object and completes the binding operation by twisting the tape into a knot. The tape is the so-called vinyl or paper tie consisting of a soft wire between layers of paper and vinyl material.

In the following we shall explain the present invention by referring to the examples embodying the present invention which are shown in the drawings. Here we shall explain the structure and operation of a binding device which binds a package such as a bundle of vegetables manually without any power, through a simple operation of a twist and binding.

SUMMARY OF THE INVENTION

The present invention relates to a binding device which wraps a binding material around an object, cuts the material away from a feed reel, and twists the material into a knot, the tightness of the wrap being controllable. The device is actuated by moving an arm to a closed position after an object to be bound is supplied to the binding position, thereby automatically moving a protective cover over an opening through which an object to be bound is inserted, wrapping the binding material around the object to be bound, cutting the material away from a feed reel and twisting the binding material into a knot at an appropriate tightness in proper sequence. Moving the arm to an open position, in which an object to be bound may be inserted into the device, automatically removes a cover and draws binding material from said reel into binding position. The binding position is at an opening into which another object or package may be inserted. Also, the movement retracts the blade which cuts the binding material from the reel at completion of a knot.

Typical binding materials are the so-called vinyl tie and paper tie which contain soft wire embedded along the center line, the wire being sandwiched between vinyl or paper ribbons on both sides. The device in accordance with the present invention may be utilized not only for such paper or vinyl ties but also for any binding material having the physical property of shape retention after twisting into a knot. In this description of the invention the binding material will generally be referred to as a tape or twist-tape, while the cut-off portion wrapped and tied around the object or package will generally be termed a tie.

The arm is connected to a pawl associated with a ratchet supported coaxially with a feed reel. When the arm has been raised to the completely open position, the pawl is released from the ratchet to retract a lever which locks to the feed reel and when the arm is lowered the tape is pulled back so as to tighten the tie. Insertion of a package or other material into the device while the arm is in open position also draws sufficient tape from the reel so that a complete loop around the object may be formed when the arm is closed.

Retention means are provided for holding the previously-cut tape end as well as the feed portion of the tape when the arm is closed so as to complete the loop around the object. A cam operates a blade to cut the tape when the arm is lowered. The previously-cut end and the newly-cut end of the tie are then twisted together into a knot by means of an intermittent mechanism also activated by lowering of the arm. The arm may be raised and lowered manually, by a foot lever, or by powered means.

Accordingly, an object of the present invention is a device for automatically tying a binding material or twist-tape around an object, a parcel, a bag or a material.

Another object of the present invention is a device for automatically looping a twist-tape around material to be tied, cutting off the requisite length of tape and twisting said tape into a knot.

A further object of the present invention is a device for automatically tying an object or parcel or material with twist-tape in which an intermittent or oscillating mechanism for twisting the tape into a knot is powered by raising and lowering an arm.

An important object of the present invention is a device for automatically tying an object or a parcel or a material with twist-tape in which insertion of an object or parcel or material to be tied automatically draws the requisite length of tape from a reel.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is made to the following description taken in connection with the accompanying drawings, in which.

DESCRIPTION OF THE PREFERRED EMBODIMENTS

Figure 1:
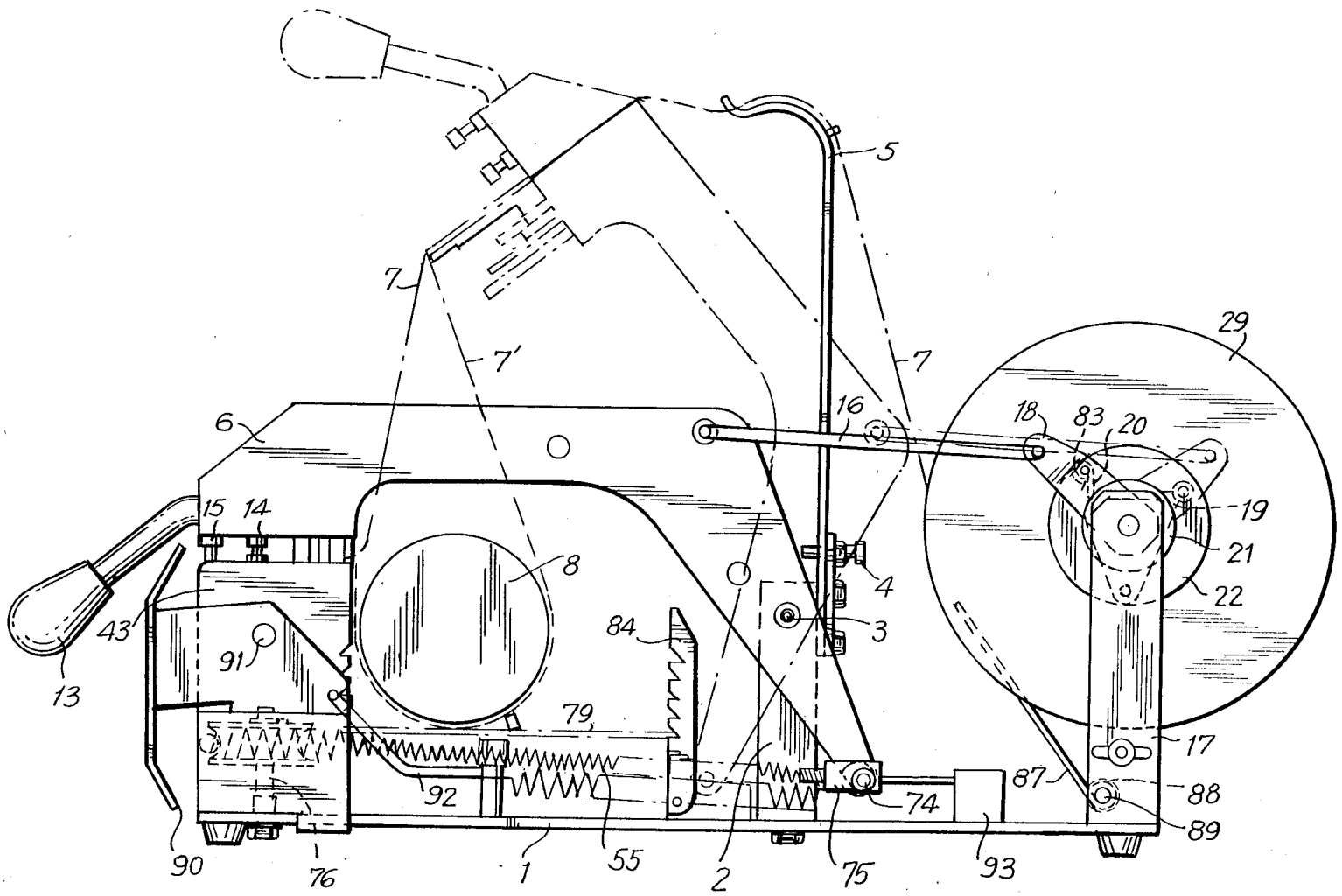
FIG. 1 is a side view of a device in accordance with the present invention.
Figure 2:
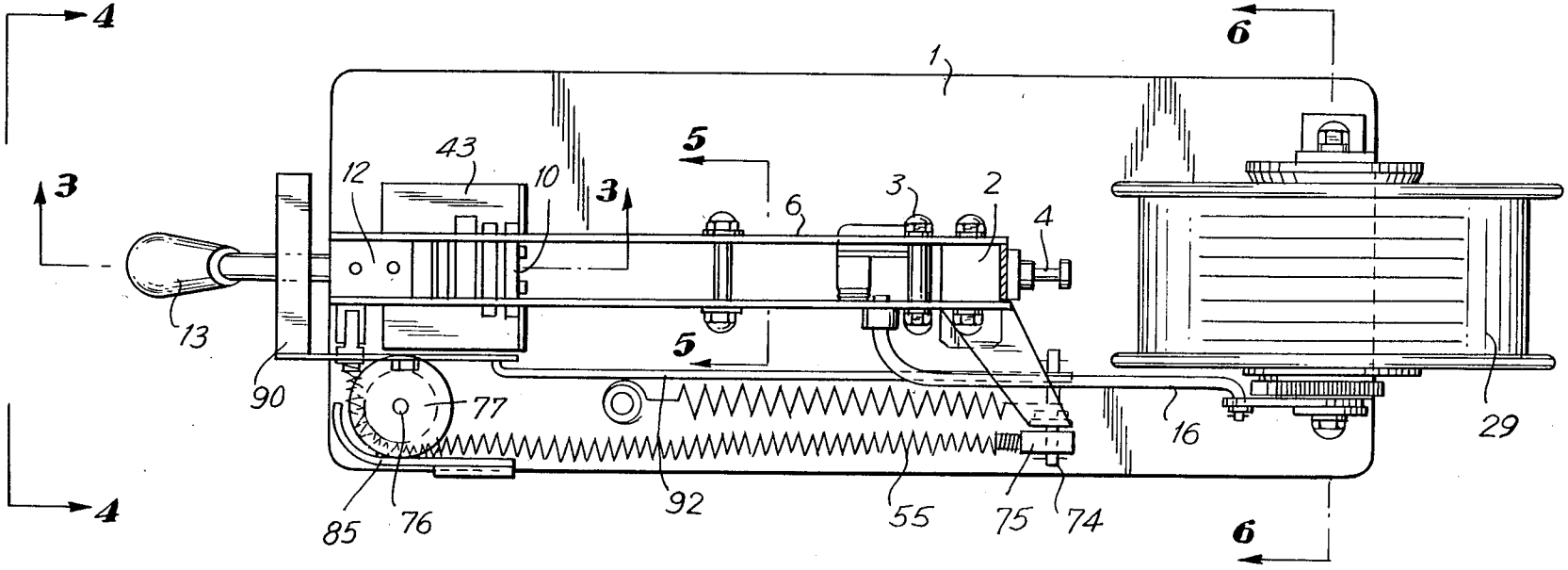
FIG. 2 is a plan view of the device.
Figure 3:
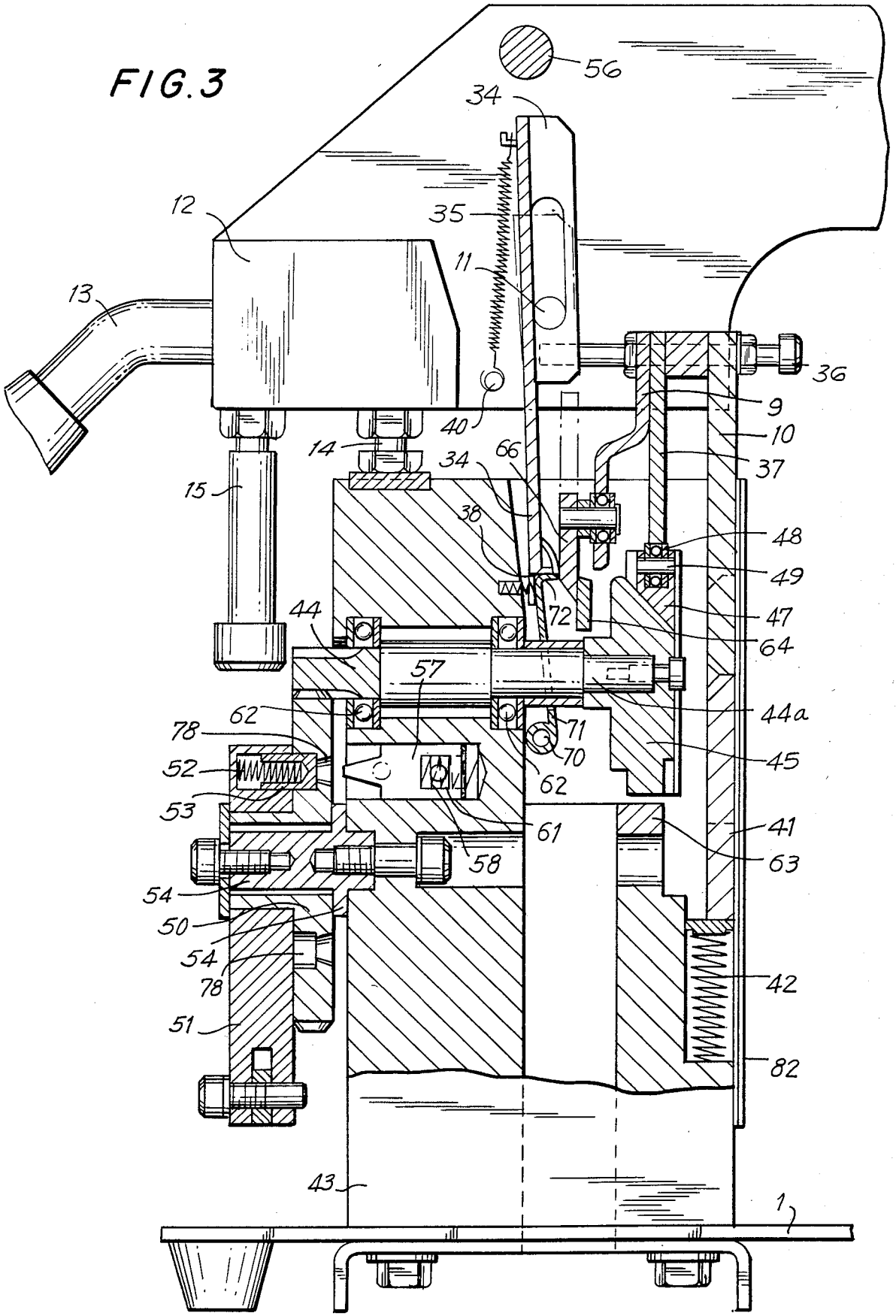
FIG. 3 is a detailed cross sectional view taken along the line 3—3 of FIG. 2.

As shown in FIGS. 1, 2 and 3, an arm 6 is attached to the upper section of a support column 2 attached to a base 1 in such a manner that the arm may be rotated with an axle 3 as a support point. It is convenient to view support column 2 and base 1 as constituting part of a frame on which all of the elements of the device are supported. A bracket 12 (FIGS. 2 and 3) equipped with a handle 13, a stop 14, a push bolt 15 at the tip, an upper press 10, a guide plate 37 (FIG. 3) for opening and closing a chuck 47 and a plate cam 9 for opening and closing a blade 66, are attached to arm 6. Also, a tape-retention member 34 is attached to support point 11 on arm 6 by spring 35 and is freely movable therewith. Stop 36 for positioning tape-retention member 34 is also attached to arm 6.

Figure 11:
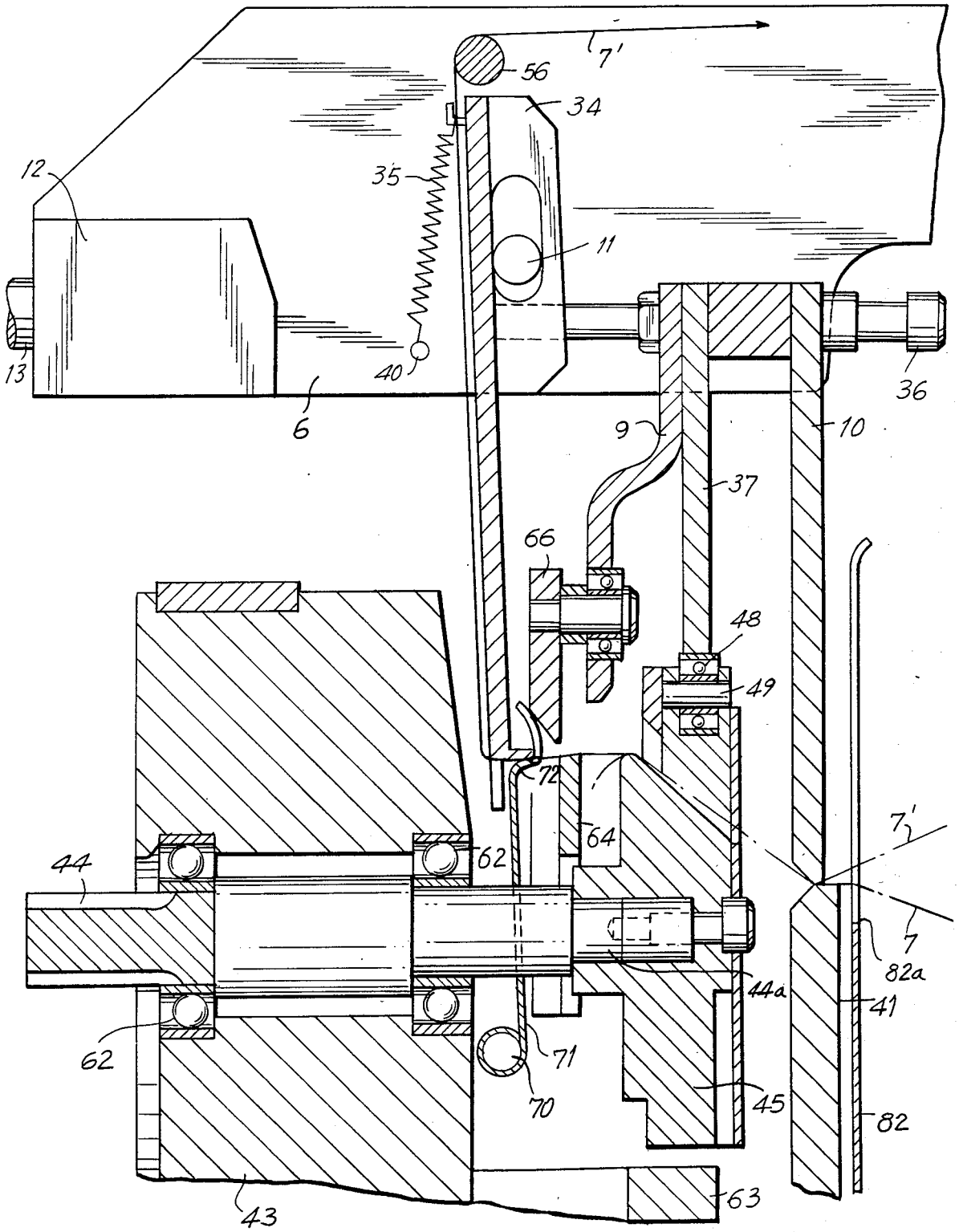
FIG. 11 is a partial sectional view showing how the tape is held immediately prior to cutting same.

To the tip section of tape-retention member 34 are attached a press section 38 (FIGS. 7 and 11) which is bent almost 90 degrees in order to retain the tape, said tip section having a notch 39 for controlling the position of the tape. FIG. 11 shows two ends of the tape which may be termed tape head 7 and tape tail 7', said tape being held between upper and lower press plates 10 and 41 and at another position between press section 38 and bent portion 72 of nipper 71.

Figure 7:
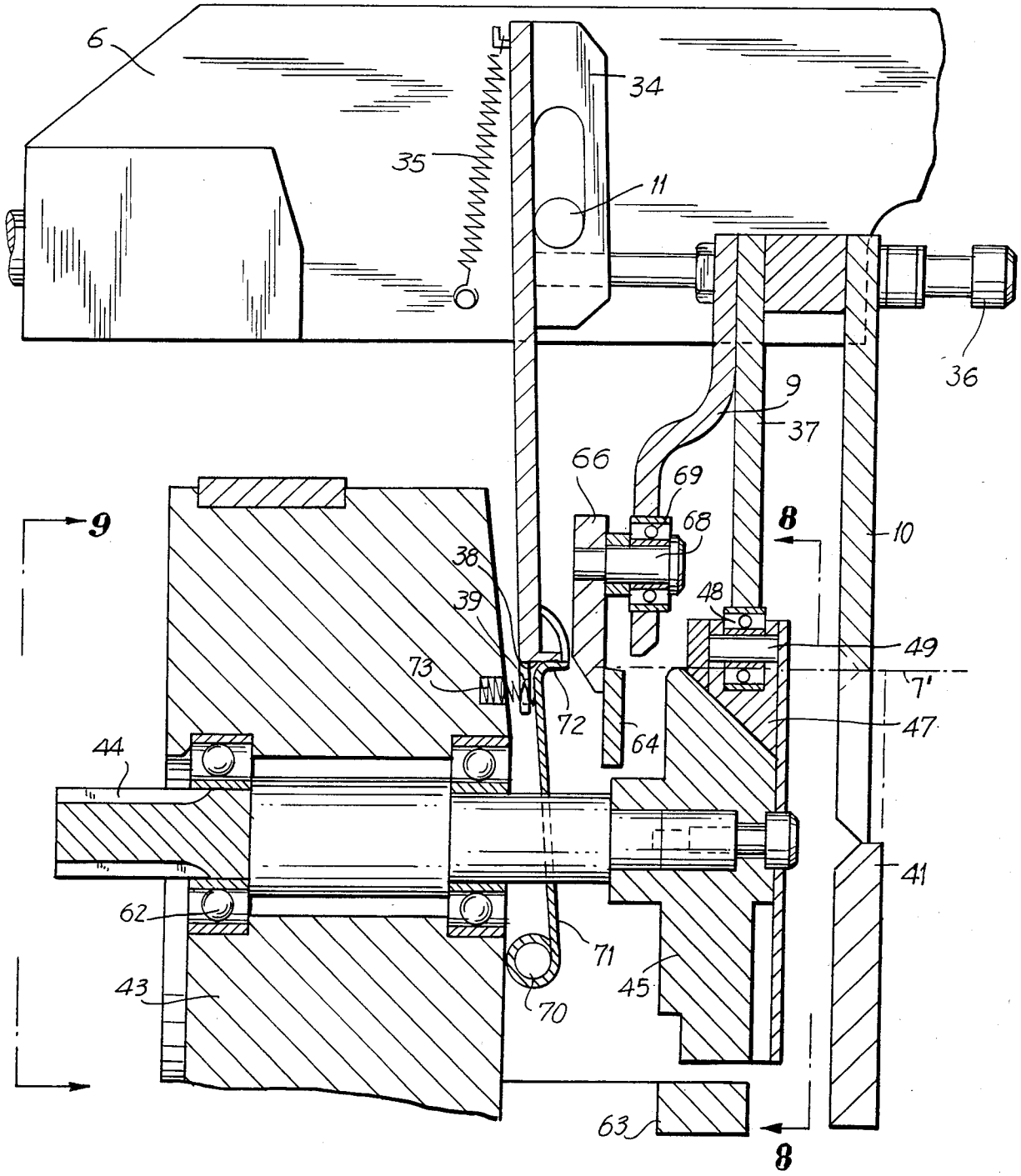
FIG. 7 is a drawing in enlarged scale of part of FIG. 3.
Figure 8:
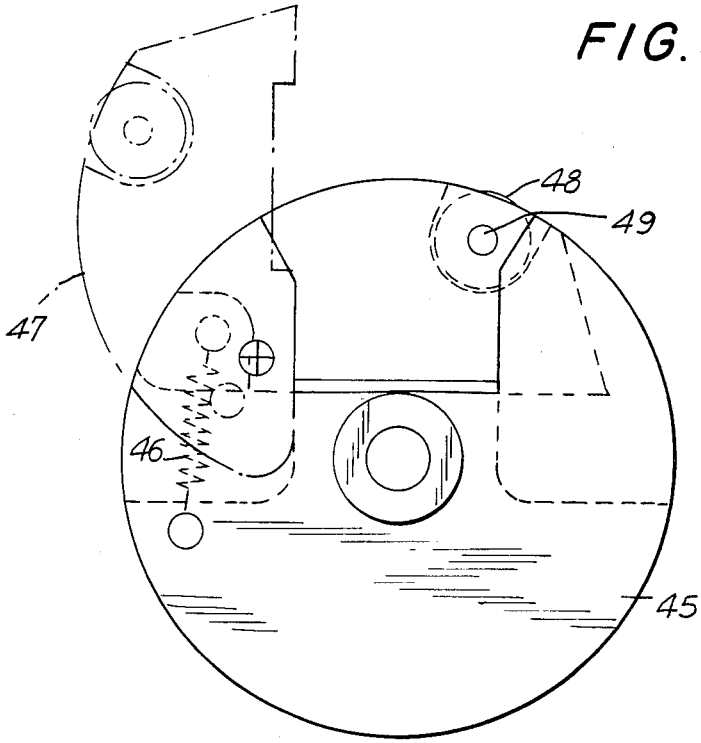
FIG. 8 is a view along the line 8—8 of FIG. 7.

A twisting device, a cutting device, and a tape-retention device are provided at positions corresponding to the position of arm 6 when the arm is lowered. As shown in FIG. 3 and FIG. 7, small gear 44 is retained in position by means of ball bearing 62 and is mounted on support 43 (FIG. 3), part of the frame. As shown in FIGS. 3, 7 and 8, rotary head 45 equipped with chuck 47 to which ball bearing 48 is attached by pin 49, is attached to an end of shaft 44*a* which also holds small gear 44. Chuck 47 is usually held in the open state by means of spring 46 (FIG. 8). Small gear 44 is engaged with large gear 50 which is attached to shaft 54 for rotation therewith. The large gear 50 is provided with holes 78 therethrough which are spaced at equal angular intervals and at equal radial distances from the center of the gear. A lever 51 (FIG. 3) is attached to shaft 54 at the outer face of large gear 50 in such a manner that it may be freely rotated about said shaft. Lever 51 (FIGS. 3 and 4) is equipped with a spring 52 urging pin 53 toward large gear 50.

A spring 58 and a pin 57 are movably attached to support 43 at a position corresponding to one of holes 78 of large gear 50, said spring 58 urging pin 57 toward the inner face of said gear. A notch section 61 is provided on the side of pin 57. Also, a lever 59 (FIGS. 4 and 13) is attached to support 43 freely rotable by means of screw 80. The lever 59 has a pin 60, which is positioned in such a manner that it may fit into the aforenoted notch section 61 of pin 57.

Closing arm 6 rotates lever 59 carrying pin 60 and draws pin 57 away from hole 78 in large gear 50, thereby allowing pin 53 to seat in hole 78 and locking lever 51 to large gear 50 for intermittent rotation therewith.

Figure 9:
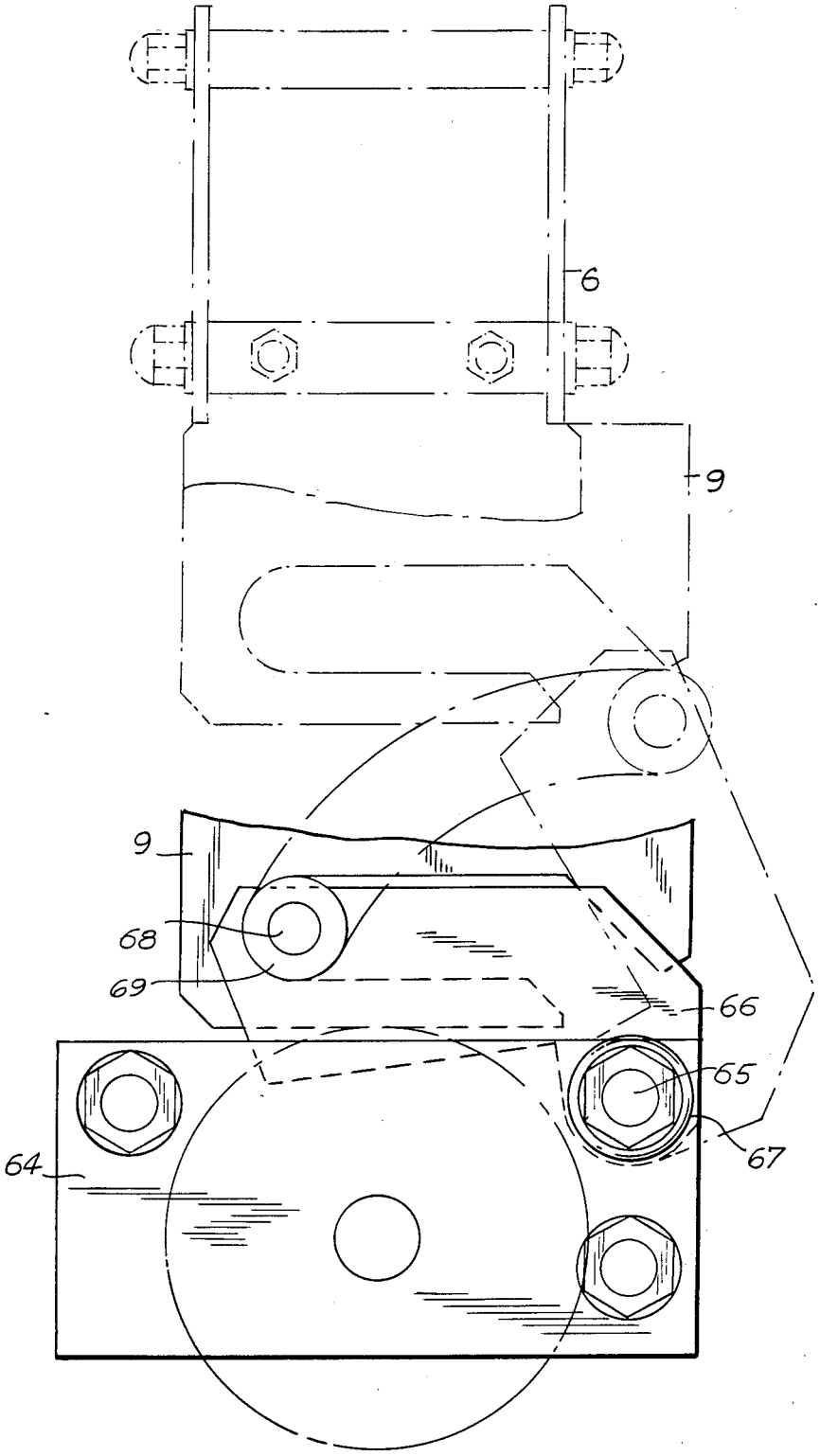
FIG. 9 is a view taken along line 9—9 of FIG. 7.

As shown in FIGS. 3 and 7, the stationary blade 64 of a cutting device is attached to stationary support 43 proximate rotor head 45, facing plate cam 9 for opening and closing blade 66 when said cam is in lowered position. As shown in FIGS. 3 and 9, rotary blade 66 is attached to stationary blade 64 through a support point 65, and is held open by the action of spring 67. In addition, a shaft 68 is attached to the tip of rotary blade 66, and said shaft is provided with a rotary roller 69. Lowering of arm 6 engages plate cam 9 with roller 69 and forces rotatable blade 66 past the cutting edge of stationary blade 64 thereby shearing the binding tape.

Figure 5:
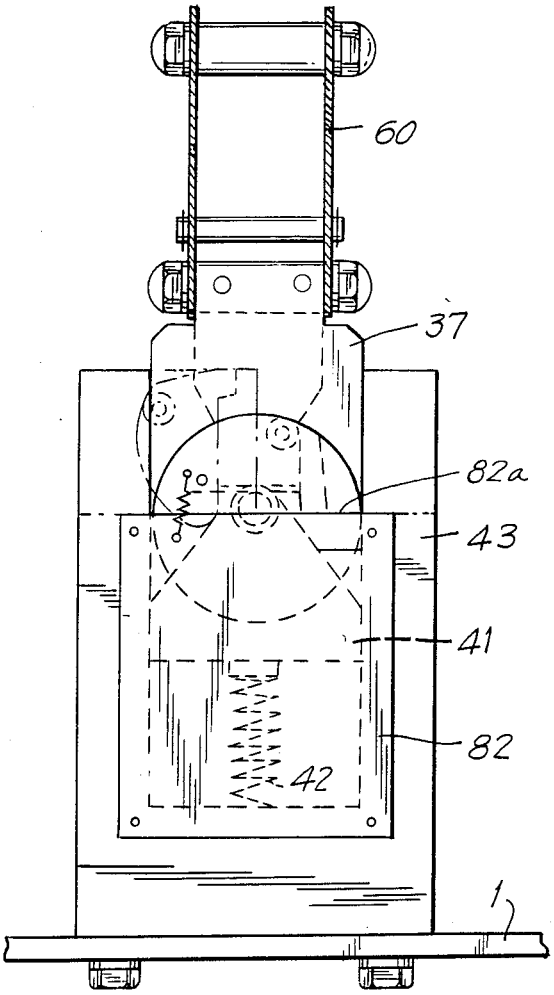
FIG. 5 is a view taken along line 5—5 of FIG. 2.
Figure 10:
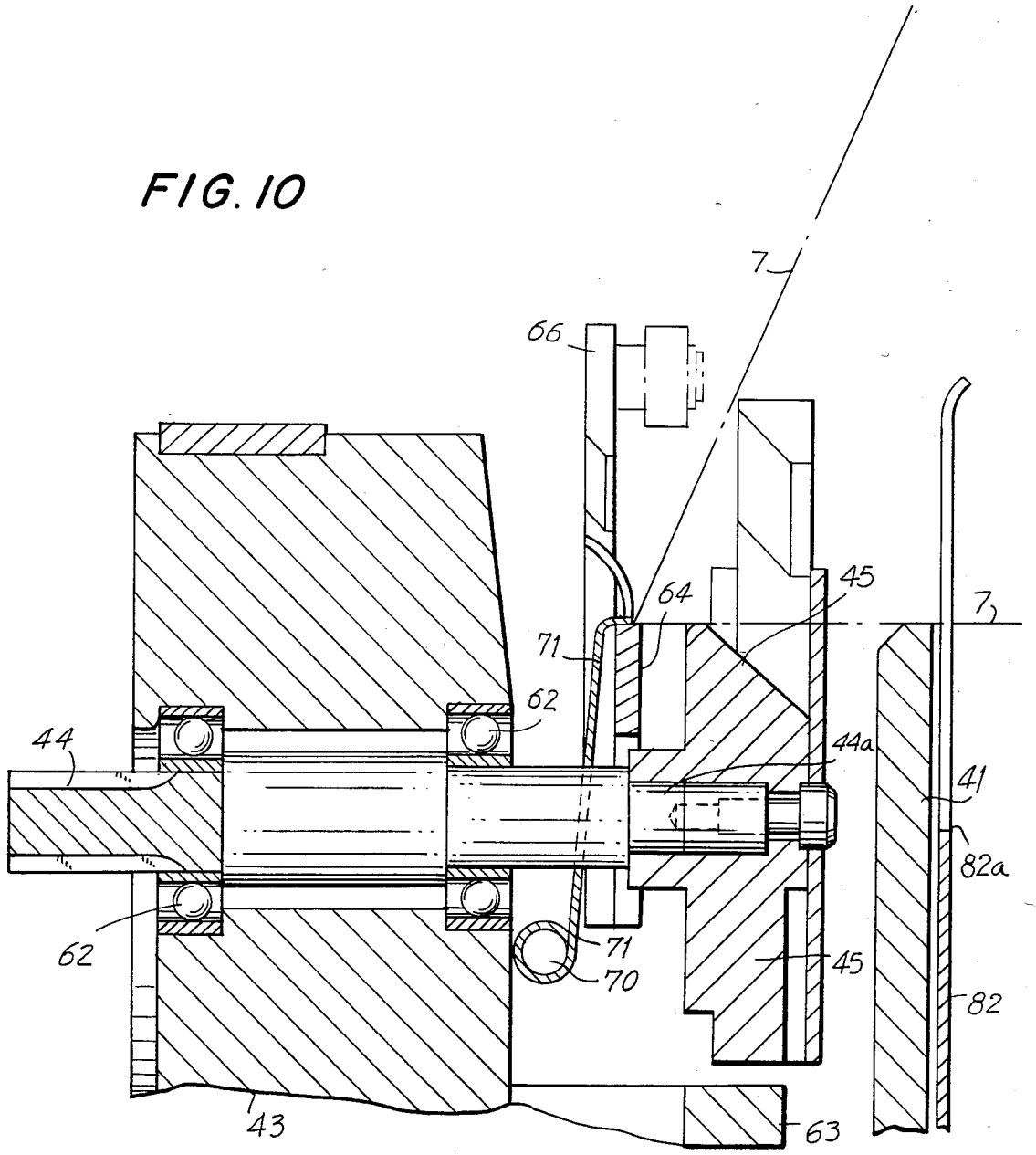
FIG. 10 is a view in enlarged scale showing how a twist-tape is held when the device is in open position.

A tape-retention device is disposed adjacent to the above-mentioned cutting device as shown in FIGS. 3 and 7. A nipper 71 is attached freely rotatably to shaft 70 which is attached to stationary support 43. An arcuate section 72 is located at the central section of nipper 71 to retain and hold the tape 7 (FIGS. 10 and 11). FIG. 10 makes it clear how the tape is held between arcuate section 72 and stationary blade 64 for the purpose of drawing tape from the reel as arm 6 is raised. A spring 73 (FIG. 7) in support 43 is provided at the back of nipper 71 which urges movable blade 66 against stationary blade 64. A lower press 41 (FIGS. 3 and 5) is mounted in support 43 through a spring 42 in a freely movable manner, facing the lowered position of upper press plate 10; also, guide plate 82 is attached to the outer face of lower press 41. Guide plate 82 has a vertical slot therein, the bottom of said slot being indicated in FIG. 10 by the reference numeral 82*a*. Slot 82*a* is provided for passage of tape portions 7 and 7' therethrough.

Figure 4:
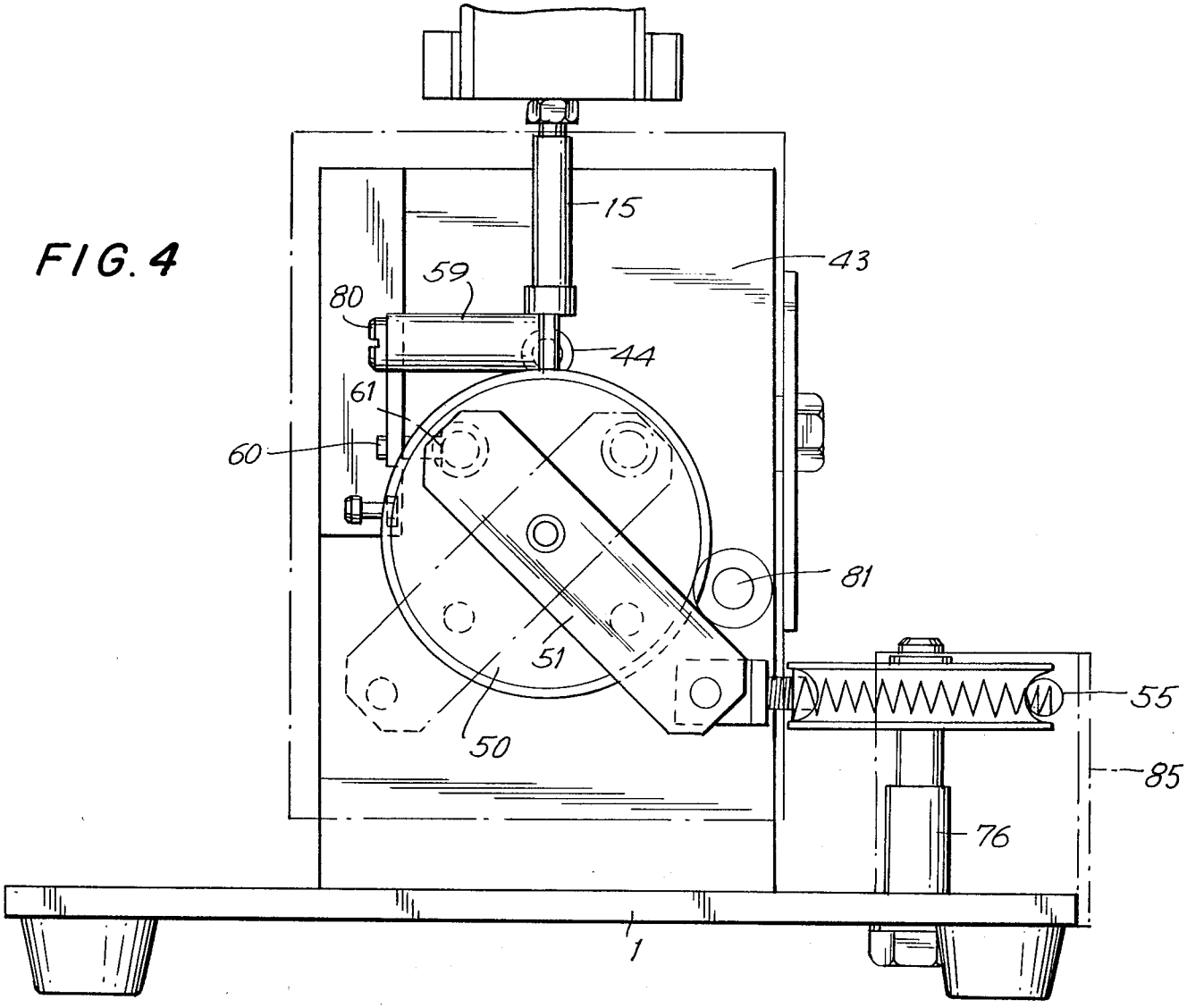
FIG. 4 is a view taken along line 4—4 of FIG. 2.

In order to actuate the device by the movement of arm 6, the following driving means are provided. As shown in FIGS. 1, 2 and 4, a tension spring 55 is connected to pin 74 which is attached to the lower end of arm 6 through a fixture 75. Spring 55 is bent through 90 degrees, as shown in FIG. 2, around a pulley 77 which may be rotated around the shaft 76 attached to base 1, and is connected to the end of the aforenoted lever 51 (FIG. 4).

A re-winding device is provided in order to render appropriate tightening when winding a tape around an object or material to be bound. The tape is held in a wound state on a reel, and therefore, a reel-holding stand is attached to the base 1. As shown in FIGS. 1, 2 and 6, a fixed side plate 17 is attached to base 1. To the upper section of side plate 17 are attached a ratchet 21, a friction plate 33 and a cone 22 in a rotatable manner; shaft 24 passes through thrust bearings 23. To the other periphery of a thrust bearing 23 is attached a lever 18 in a rotatable manner; a pawl 20 for cooperation with said ratchet 21 is provided on lever 18 so that it may be engaged with ratchet 21 in only one direction. The pawl is appropriately urged toward the ratchet by means of helical spring 83. This lever 18 is connected to arm 6 through a connecting rod 16, and reciprocates therewith.

A movable side plate 25 (FIG. 6) is attached to base 1 through a hinge 26 so that it faces fixed side plate 17. A cone 27 is attached to movable side plate 25 through thrust bearing 23 so as to be rotatable with reel 29 with shaft 28 as a center. Fixed side plate 17 and movable side plate 25 are urged toward each other by means of tension spring 30, the tension being adjustable by means of screw 31 and wing nut 32. As is evident, rotation of side 25 on hinge 26 makes it possible to change reels.

The device operates as follows:

A tape 7 (FIG. 1) is sandwiched between the tip of nipper 71 (FIGS. 3, 4 and 10) and stationary blade 64. The tape passes from tape reel 29 through a tape guide 5 (FIG. 1) attached to support column 2 and over stay 56 (FIG. 3) on arm 6, and is stretched as shown with chained line 7 in FIG. 1. Tape guide 5 is positioned to stretch the tape approximately along the opening and closing trajectory of arm 6. Arm 6 is readied in a position shown with the chained line in FIG. 1, that is, in the open position. At this time, the rewinding device is at the position in which lever 18 is located at a position indicated with the chained line in FIG. 1. Therefore, pawl 20 for ratchet 21 is separated from the ratchet by means of plate cam 19 (FIG. 1), and reel 29 is in a state in which it may be rotated without resistance to feed binding tape. When an object or package 8 to be bound is inserted into the binding position, the tape is moved by the object into the position indicated with broken line 7′ in FIG. 1. Then, when arm 6 is closed by means of handle 13, the tape is wound therearound in a loop form by means of upper press 10 (FIG. 11), and the two loop ends are held in an overlapped state by means of lower press 41. In order to prevent the object being bound from being caught or clipped by the mechanism there is provided a slotted guide plate 82 (FIG. 3) at the reelward portion of support 43. Also, tape-retention member 34 presses the tape against arcuate section 72 located at the central part of nipper 71. At this time, the tape assumes a horizontal straight line as shown with broken line 7′ in FIG. 7. In this position the tape may be cut and may be seized by chuck 47.

When arm 6 is lowered, plate cam 9 (FIG. 9) pushes rotary roller 69 provided on rotary blade 66, and thus blade 66 begins to close toward stationary blade 64. At this time, blade 66 pushes the tip of nipper 71 open (FIGS. 7 and 11), thereby freeing the ends of the binding tape sandwiched therebetween, and side pressure required for cutting is exerted onto the rotary blade by nipper 71. At the same time, upper press 10 pushes down lower press 41, and the two tape portions sandwiched therebetween are pulled out by being lowered, the end portions of the tape sandwiched therebetween are separated from the cutting surfaces of the blade, only one of the two tapes being cut, and thus the looped section wound around the material to be bound is separated.

Figure 12:
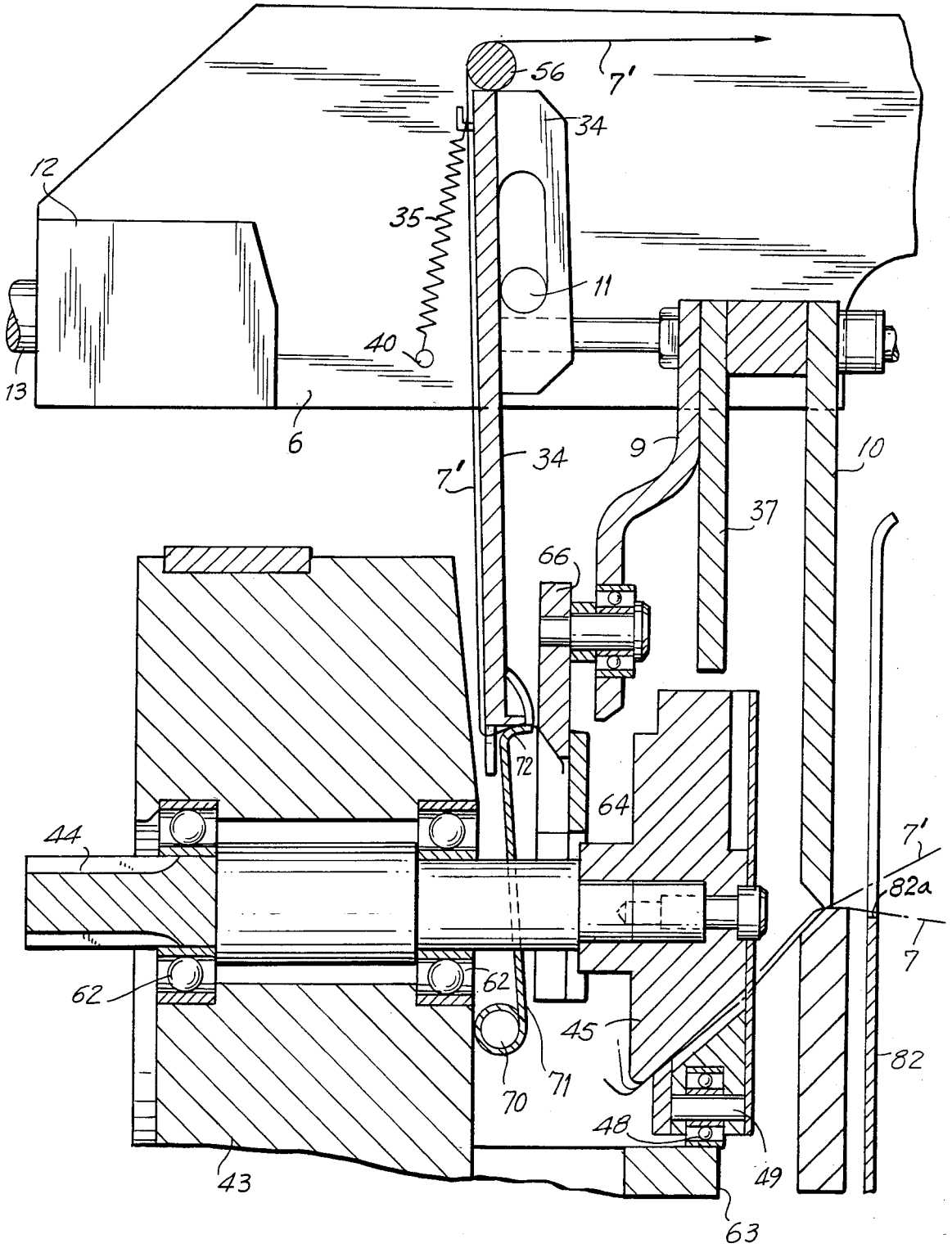
FIG. 12 is a view illustrating the twisting of the tape.

Simultaneous with this motion of blade 66, guide plate 37 positioned between the upper press 10 and the plate cam 9 closes chuck 47 in a manner to be described below, the opening between upper press 10 and lower press 41 also being closed, thereby overlapping two ends of the cut tape, and allowing rotary head 45 to hold them (FIG. 12). By the rotation of rotary head 45 in this state, the tie is twisted into a knot. When guide plate 37 is lowered, as shown in FIG. 3, chuck 47 is thereby closed to hold the tape. The outer periphery of the chuck forms part of a complete circle when closed. The shape of the lower end of guide plate 37 is semi-circular (not shown), with the same radius as this circle, and part 63 of the support also has a semi-circular shape of the same radius (not shown). Therefore, when guide plate 37 is lowered by lowering of arm 6, chuck 47 is closed, and during the twisting step, the chuck may rotate while being held closed by guide plate 37 when the chuck is positioned at the upper half of the circle, and by the top surface 63 when it is positioned at the lower half of the circle. This circle is concentric with the center of the rotation of rotary head 45, and therefore, it is possible for chuck 47 to rotate in closed condition.

The numbers of teeth of small gear 44 and large gear 50 are in such a ratio that an appropriate number of twists may be achieved by lever 51 (FIGS. 3 and 4) as it swings through the angle determined by the successive holes 78 in large gear 50. Holes 78 are provided on large gear 50 with a pitch equal to the swinging angle.

Figure 13:
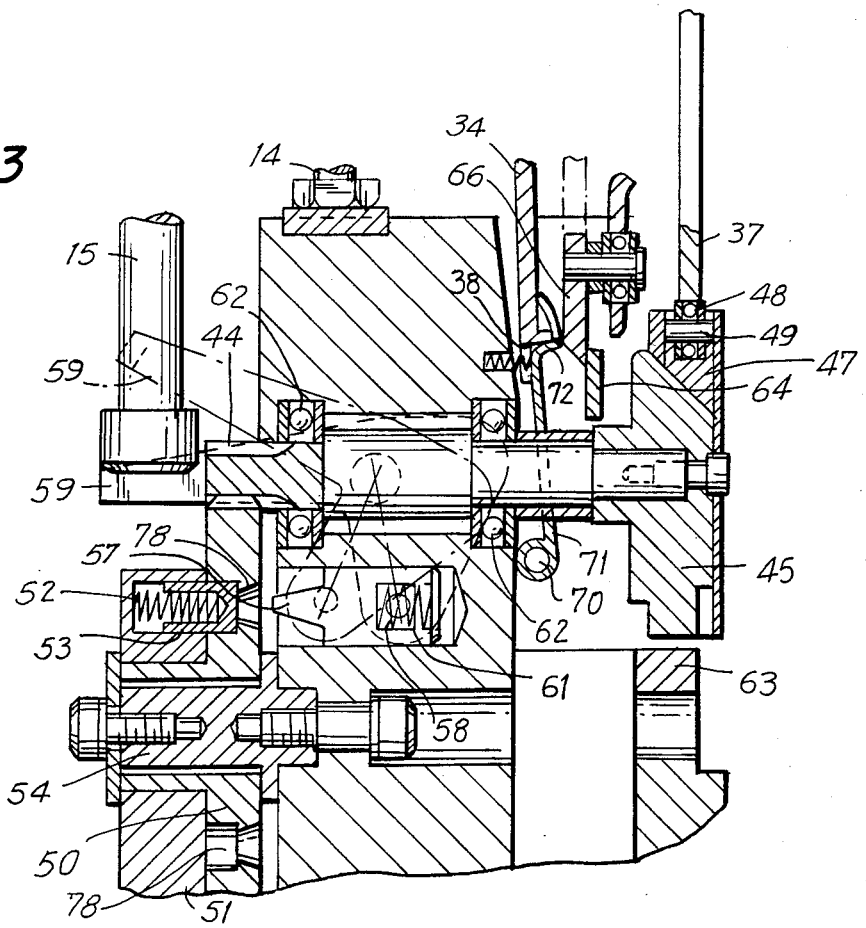
FIG. 13 is a partial view corresponding to FIG. 3 but showing the mechanism by which closing of the arm activates the twisting means.

As shown in FIG. 4, lever 51 performs a reciprocating motion between the positions indicated with the solid line and the chained line. In the position indicated by the solid line, pin 53 (FIG. 3) and pin 57 are at opposing positions. When arm 6 is opened, lever 51 is at the position indicated by the chained line, pin 53 is inserted in one of the holes 78 under the urging of spring 52, and lever 51 and large gear 50 are fixed to each other. Therefore, lever 59 is fixed at the position indicated by the chained line, as shown in FIGS. 4 and 13. As shown in FIGS. 3 and 4, pin 57 may be pulled out by pushing one end of lever 59 by push bolt 15 in the neighborhood of the lowered end of arm 6, and large gear 50 which has been fixed to lever 51 by pin 53, is released from support 43, and large gear 50 and lever 51 are rotated together by the action of a spring 55 (FIGS. 1 and 2) to be described later, thereby bringing lever 51 to the position indicated by the solid line. This position is determined by stop 81 (FIG. 4). In connection with this motion, rotary head 45 is rotated by an appropriate number of rotations through small gear 44, thereby twisting the binding material, and chuck 47 comes again to the position facing guide plate 37. In this manner, the twist-binding is completed by the lowering of the arm 6, and the lowering limit is established by the stop 14.

When arm 6 is raised, the tape-retention device acts as follows while tape ends are retained. As shown in FIG. 3, at the lowered position of arm 6, blade 66 is completely closed, nipper 71 is completely opened, and the edge sections of the tie newly formed by the cutting are positioned at curved section 72 at the center of the nipper. At this time, the tape is pressed against nipper 71 by means of tape-retention device 34 (FIG. 11), thereby being held stationary. When arm 6 is raised, blade 66 is opened by means of plate cam 9, nipper 71 is pressed against stationary block 64 by means of spring 73, and the newly formed end sections of the tie are sandwiched therebetween and retained therein. At this time, tape-retention device 34, attached to arm 6 in a movable manner, follows the motion of nipper 71, effectively preventing the end sections of the tape from being separated from nipper 71. Press section 38 holds the newly-formed end portion of the tape and acts to retain the tape by pressing it against the arcuate end 71 of said nipper.

In addition, when arm 6 is raised, push bolt 15 is also raised, thereby disengaging the push bolt from lever 59 (FIG. 13). Pin 57 is pushed toward large gear 50 by spring 58, pushing out pin 53 on the same axis from hole 78 against the force of spring 52, thereby fixing large gear 50 to support 43 and disengaging lever 51 from large gear 50. Lever 51 is returned to the position indicated with the chained line in FIG. 4 by means of a driving means to be described later, at which time the lever again becomes fixed to the large gear 50 by means of hole 78 (FIG. 3) and pin 53.

As is evident, rotary head 45 rotates only in one direction; and large gear 50 is fixed in position as mentioned above while arm 6 is being raised. With the raising of arm 6, chuck 47 is opened to permit removal of a bound package. When arm 6 is raised to the position in which it makes contact with stop 4, as shown in FIG. 1, the binding tape is stretched into its original state, and thus the next bundle to be bound may be inserted into the device.

The driving means moves lever 51 by the action to be described below. Since lever 51 is fixed as aforenoted, when arm 6 is closed, spring 55 (FIG. 1) is stretched through the fixture 75 by the movement of pin 74 attached to the lower end of arm 6, thereby accumulating tension to rotate lever 51.

As aforenoted, when the lever 51 becomes free at the closed position of arm 6, it may be rotated by the action of spring 55.

As arm 6 begins to be raised, large gear 50 is fixed by the action of the pin 57 (FIG. 3) as described above, and lever 51 is released from large gear 50. Simultaneously, the completely compressed spring 55 (FIG. 4) is pushed by pin 74 (FIGS. 1 and 2) at the lower end of arm 6; the force acts in the 90 degree direction as the result of the bend of the spring around pulley 77 and guide 85 is located at the outer periphery of pulley 77, thereby returning the lever 51 to the position indicated with the chained line in FIG. 4, and it is fixed to large gear 50 by means of pin 53 (FIG. 3).

For the sake of ease of operation and elimination of fatigue on the part of the operator, arm 6 may be fitted with a spring (not shown) arranged so as to be compressed by lowering of arm 6 and which assists in raising same.

Figure 6:
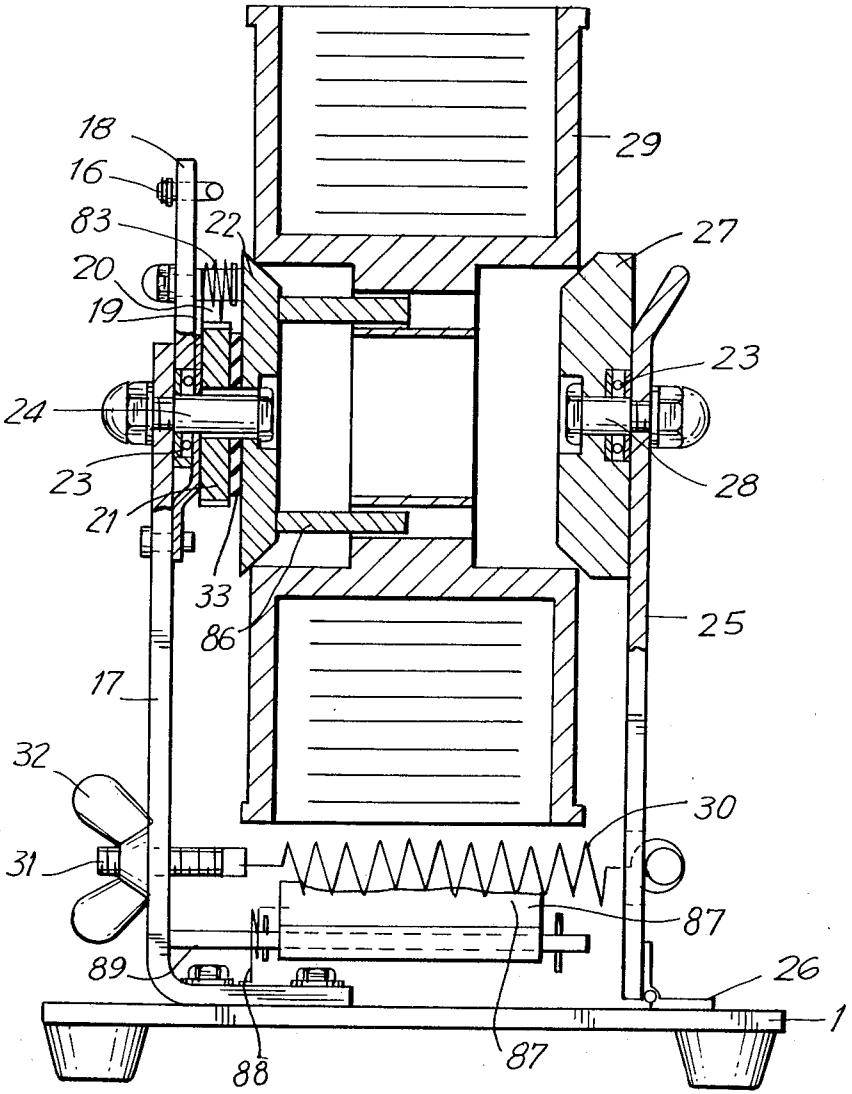
FIG. 6 is a view taken along line 6—6 of FIG. 2.

The re-winding device provides for tightening of the tape to an appropriate degree by the following actions. As described above, when arm 6 is in the opened position, binding tape may be pulled from the reel without any resistance, but as shown in FIGS. 1, 2 and 6, as the arm is lowered, pawl 20 engages ratchet 21, and the rotation of the lever 18 is transmitted to cone 22 through friction plate 33 as the result of the action of spring 30 under tension. Pin 86, provided on cone 22, is inserted in the hole of the tape reel 29, and the reel is urged in the re-winding direction. In addition, since pawl 20 is rotated in the disengage direction when arm 6 is opened, no force is transmitted during the opening step in the operation. The re-winding force serves to hold the tape taut and the force may be adjusted by means of screw 31 and the wing nut 32. If the reel 29 were to rotate too far at the tape pulling-out position due to inertia, the binding material might come loose from the reel 29. In such case, racing of the reel is prevented by applying a brake plate 87 (FIG. 1) on the periphery of reel 29. The brake plate is supported on shaft 89 and is urged against the reel by spring 88.

In order to improve the ease of handling objects to be bound, a table 79 (FIG. 1) and a removable cover 90 are provided. The height of table 79 may be adjusted depending on the diameter or thickness of an object 8 to be bound, by providing notches at several positions of support column 84 proximate the central section of the base 1 and the surface of support 43 facing toward reel 29.

Removable cover 90 is attached to support 43 by means of axle 91 at the support point, and is connected to pin 74 at the lowermost section of arm 6 by means of link 92. When arm 6 is completely opened, cover 90 is positioned over the upper surface of support 43, allowing an object to be bound to be inserted and placed on table 79 without any hindrance.

As mentioned above, the present invention allows one to bind an object by twisting a tape around the object and forming it into a knot, even if the object to be bound is thick and irregular in shape. Furthermore, it is possible to control the tightness of the binding, and the binding material is cut to an appropriate length each time, thereby achieving the desired economy. Moreover, the entire twist-binding operation is achieved just by the opening and closing operations of arm 6, thereby reducing fatigue in the operator.

In this description of the invention, it has been assumed that arm 6 is opened and closed in the vertical direction. However, the device may obviously be constructed so as to open and close in a horizontal or other direction, depending on the direction of the supply of objects or other material to be bound. Furthermore, the arm may be moved in the opening and closing directions by mechanical, hydraulic or electromechanical means indicated schematically by box 93 linked to arm 6 in FIG. 1. The means for moving arm 6 may be activated by a foot pedal, a manual switch or a switch activated by insertion of the object to be bound.

It will thus be seen that the objects set forth above, and those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A binding device for tying a binding material, hereinafter referred to as a tape, about a package or other object, said tape having the characteristic of retaining a twisted shape on being bent or twisted into same, said device comprising:

(a) a frame;

(b) a movable arm hinged to said frame and movable between open and closed positions relative to said frame;

(c) package-support means on said frame, said arm being shaped to permit positioning of material to be tied on said package-support means when said arm is in said open position;

(d) tape-drawing means for drawing tape from a reel to a package positioned in said device for being tied, said arm being constructed and arranged for winding said tape around said package by the opening and closing of same;

(e) tape-cutting means on said frame for cutting said tape after said tape is wound about said material, thereby forming a cutoff portion of said tape having two ends and a reel-tape end connected with said reel;

(f) twisting means on said frame for twisting said ends of said cut-off portion sufficiently so that they form a knot, said arm further being arranged and constructed for operating said tapedrawing means, said tape-cutting means and said twisting means in proper sequence by opening and closing of same; wherein said twisting means comprises:

a first shaft mounted on said frame;

a smaller gear and a rotary head mounted at opposite ends of said shaft for rotation together;

a second shaft mounted on said frame;

a larger gear having inner and outer faces relative to said frame, said larger gear being mounted on said second shaft and meshing with said smaller gear for driving same, said second shaft having an outer end and an inner end relative to said frame; said larger gear having holes therethrough from said outer face to said inner face, said holes being spaced at equal angular distances and at equal distances from the axis of said second shaft;

retractable holding means associated with said frame for cooperating with one of said holes and holding said larger gear stationary during opening of said arm;

first lever means mounted on the outer end of said second shaft, said larger gear being mounted adjacent said first lever means;

retractable coupling means associated with said first lever means for fixing said lever means to said larger gear by means of said one of said holes, said retractable holding means being disposed for barring access to said one of said holes by said retractable coupling means when said arm is in open position;

second lever means mounted for rotation to said frame;

push-bolt means disposed on said arm for rotating said second lever means during the closing of said arm, said second lever means engaging said retractable holding means for retracting same from said one of said holes on rotation of said second lever means by said push-bolt means and thereby permitting coupling of said larger gear to said first lever means; and linking means connecting said arm with said first lever means for rotating said first lever means and thereby said larger gear through an angle equal to the angular spacing between said holes on closing of said arm.

2. The binding device, as described in claim 1, further comprising tape-retention means on said frame for holding said reel-tape end of said tape during opening of said arm and for drawing tape from a reel.

3. The device, as defined in claim 1, wherein said retractable holding means comprises first pin means mounted in said frame and first spring means disposed for urging said first pin means toward the inner face of said larger gear, said first pin means having a notch therein for receiving said second lever means and being retracted thereby.

4. The device, as defined in claim 1, wherein said retractable coupling means comprises second pin means mounted in said first lever means and second spring means disposed for urging said second pin means toward the outer face of said larger gear and into one of said holes when in registry therewith.

5. The device, as defined in claim 1, further comprising chuck means mounted on said rotary head for holding the cut ends of a loop of tape around said package and for twisting same into a knot by rotation of said head.

6. The device, as defined in claim 2 wherein said tape-retention means comprises:

flexible and rotatable nipper means mounted on said frame, said nipper means having an arcuate end; and tape-pressing means being mounted on said arm, said nipper means and said tape-pressing means being so disposed that on closing said arm, a portion of said tape-pressing means and said arcuate end come together and are enabled to cooperate in holding a cut end of said tape.

7. The device, as defined in claim 1, wherein said tape-retention means further comprises upper press means having a first end and mounted on said arm, lower press means having a second end and mounted on said frame and third spring means mounted on said frame, said upper and lower press means being disposed for meeting at said first and second ends and holding said tape therebetween as said arm is closed and said third spring means being disposed for urging said lower press means toward said upper press means.

8. The device, as defined in claim 1, further comprising guide plate means mounted on sad frame continuously with said lower press means for guiding said upper press means into registry with said lower press means and for preventing entanglement of a package to be bound with said device, said guide means being slotted for transit of tape therethrough.

9. The device, as defined in claim 1, wherein said cutting means comprises a movable blade, and a stationary blade mounted to said frame, and cam means mounted to said arm, said cam means being disposed for engaging said movable blade and moving same to cut said tape during closing of said arm.

10. The device, as defined in claim 9, further comprising roller means mounted on said movable blade for engagement with said cam means.

11. The device, as defined in claim 9, wherein said nipper is disposed for urging the faces of said stationary and movable blades together to ensure effective shearing of said tape and further comprising fourth spring means mounted on said frame for uging said nipper means toward said blades.

12. The device, as defined in claim 1, further comprising removable cover means mounted on said frame for protection of said device during opening and closure of said arm and for permitting access when said arm is in open position.

13. The device, as defined in claim 1, further comprising reel support means mounted on said frame for holding rotably a reel with tape wound thereon, and second linking means connecting said reel support means with said movable arm, said second linking means and reel support means being arranged and constructed for locking said reel against rotation when said arm is in closed position and for permitting rotation of said reel during opening of said arm and when said arm is in open position.

14. The device, as defined in claim 1, further comprising tightening means associated with said reel support means for holding tape on said reel taut during binding of an object.

15. The device, as defined in claim 1, wherein said tightening means comprises third lever means, pawl means mounted to said third lever means, ratchet means and friction plate means being mounted on said reel support means and said third lever means being connected with said second linking means and said ratchet means and pawl means for urging said friction plate means against a reel in said reel support means for resisting rotation of said reel during binding of an object.

* * * * *